US010683183B2

(12) United States Patent
Perini et al.

(10) Patent No.: US 10,683,183 B2
(45) Date of Patent: Jun. 16, 2020

(54) PAPER CONVERTING PLANT

(71) Applicant: FUTURA S.P.A., Capannori (IT)

(72) Inventors: Fabio Perini, Viareggio (IT); Giovacchino Giurlani, Segromigno in Monte Capannori (IT)

(73) Assignee: FUTURA S.P.A., Capannori (IT)

( * ) Notice: Subject to any disclaimer, the term of this patent is extended or adjusted under 35 U.S.C. 154(b) by 165 days.

(21) Appl. No.: 15/774,292

(22) PCT Filed: Dec. 2, 2016

(86) PCT No.: PCT/IT2016/000285
§ 371 (c)(1),
(2) Date: May 8, 2018

(87) PCT Pub. No.: WO2017/130228
PCT Pub. Date: Aug. 3, 2017

(65) Prior Publication Data

US 2019/0071272 A1 Mar. 7, 2019

(30) Foreign Application Priority Data

Jan. 25, 2016 (IT) ..... UB2016A0458

(51) Int. Cl.
*B65H 19/12* (2006.01)
*B31F 1/07* (2006.01)

(52) U.S. Cl.
CPC ..... *B65H 19/12* (2013.01); *B31F 1/07* (2013.01); *B31F 2201/0776* (2013.01); *B65H 2301/41702* (2013.01); *B65H 2301/41732* (2013.01)

(58) Field of Classification Search
CPC ..... B65H 2301/41732; B65H 2801/84; B65H 19/30; B65H 2301/41702;
(Continued)

(56) References Cited

U.S. PATENT DOCUMENTS 3,556,907 A 1/1971 Nystrand
6,030,496 A * 2/2000 Baggot ..... B65H 16/10 162/111
(Continued)

FOREIGN PATENT DOCUMENTS

EP 0310264 A2 * 4/1989 ..... C04B 18/241
EP 0980751 A1 2/2000
(Continued)

OTHER PUBLICATIONS

International Search Report and Written Opinion dated Apr. 6, 2017 of corresponding application No. PCT/IT2016/000285, 9 pgs.

*Primary Examiner* — Jose A Fortuna
(74) *Attorney, Agent, or Firm* — Maier & Maier, PLLC

(57) ABSTRACT

Paper converting plant, including means for producing logs of paper material starting from one or more paper webs fed by corresponding reels, an embossing unit, a bridge crane with arms provided with grippers, and a rewinder that produces logs using the webs coming from the embossing unit, wherein the embossing unit is arranged to be configured in a first use configuration in which one or more embossing rollers positioned inside it are stably locked to respective support means and a second removal configuration in which said one or more embossing rollers are disengaged from said support means and can be extracted from the embossing unit, the plant also includes a storing unit in which are stored one or more embossing rolls according to a predefined storage order such that each embossing roller occupies a predetermined position in the same storage unit, each embossing roller having a respective longitudinal axis.

8 Claims, 9 Drawing Sheets

(58) Field of Classification Search
CPC ..... B65H 2301/41734; B65H 19/2269; B65H 20/16; B65H 2408/235; B65H 2701/1924; B65H 19/12; B65H 2301/41346; B31F 1/07; B31F 2201/0776; B31F 2201/0779; Y10S 414/124; B31B 50/88; B31B 70/88
See application file for complete search history.

(56) References Cited

U.S. PATENT DOCUMENTS

| | | | | |
|---|---|---|---|---|
| 7,040,565 | B2 | 5/2006 | Fabio | |
| 7,350,739 | B2 | 4/2008 | Maddaleni et al. | |
| 7,458,538 | B2 | 12/2008 | Betti et al. | |
| 7,481,643 | B2 | 1/2009 | Catelli | |
| 7,543,775 | B2 * | 6/2009 | Benvenuti | B65H 19/12 242/559 |
| 7,618,004 | B2 | 11/2009 | Gelli et al. | |
| 10,315,873 | B2 * | 6/2019 | Perini | B65H 19/126 |
| 10,364,114 | B2 * | 7/2019 | Perini | B65H 19/30 |
| 2007/0108336 | A1 * | 5/2007 | Benvenuti | B65H 16/103 242/533.8 |
| 2015/0259169 | A1 * | 9/2015 | Giurlani | B41F 13/03 226/92 |
| 2017/0233209 | A1 * | 8/2017 | Perini | B65H 75/243 242/571.8 |
| 2017/0240369 | A1 * | 8/2017 | Perini | B65H 19/126 |
| 2017/0240370 | A1 * | 8/2017 | Perini | B65H 26/00 |
| 2017/0240378 | A1 * | 8/2017 | Perini | B65H 75/242 |
| 2019/0071272 | A1 * | 3/2019 | Perini | B65H 19/12 |
| 2019/0322068 | A1 * | 10/2019 | Giurlani | B31F 1/07 |

FOREIGN PATENT DOCUMENTS

| | | | | |
|---|---|---|---|---|
| EP | 1765584 | A1 | 3/2007 | |
| EP | 3197804 | B1 * | 5/2018 | B65H 19/126 |
| EP | 3197803 | B1 * | 8/2018 | B65H 49/38 |
| EP | 3408203 | B1 * | 4/2019 | B65H 19/12 |
| WO | 2010034890 | A2 | 4/2010 | |
| WO | 2015150452 | A1 | 10/2015 | |
| WO | WO-2016046852 | A1 * | 3/2016 | B65H 49/38 |
| WO | WO-2016046854 | A1 * | 3/2016 | B65H 75/243 |
| WO | WO-2016046856 | A1 * | 3/2016 | B65H 19/30 |
| WO | WO-2017130228 | A1 * | 8/2017 | B65H 19/12 |
| WO | WO-2019077639 | A1 * | 4/2019 | B65H 19/2269 |

* cited by examiner

PAPER CONVERTING PLANT

FIELD

The present invention relates to the handling of the embossing rollers in paper converting plants.

BACKGROUND

It is known that the embossing units are commonly used in the paper converting plants to produce, for example, rolls of kitchen paper, toilet paper, paper towels and so on. The embossing has the main function to confer greater volume, higher liquid absorption capacity and surface designs to the plies that form the paper web which is subsequently rolled on cardboard tubes by means of a rewinder and then subjected to transverse cut in cutting-off machines.

Essentially, the embossing process implies the passage of one or more plies of paper between an embossing roller, the surface of which is provided with tips or reliefs according to a predefined scheme, and a counter-roller. Therefore, a ply that is smooth before the embossing process takes place, is so shaped as to exhibit a set of reliefs and depressions corresponding to the arranged embossing pattern on the embossing roller. If the web is composed by more plies, for example two, these can be both embossed and then joined together by gluing in a so-called tip-to-tip configuration, in which the reliefs of a ply are opposite to the other's ply reliefs, or in so-called nested configuration in which the reliefs of a ply are in each other's ply depressions.

The machines in which the embossing process takes place are commonly called "embossing units". Generally, the embossing units are arranged to allow the rollers exchange, i.e. the replacement of one or more embossing rollers to change the embossing patterns on the paper or for maintenance operations. Generally, such embossing units have a structure comprising a fixed part and a movable part which is moved with respect to the fixed part to allow access to the parts supporting the embossing rollers in order to release and replace the latter when required. U.S. Pat. No. 7,618,004, EP1765584 and U.S. Pat. No. 7,458,538 disclose embossing units of this type.

The embossing rollers for use in machines of the type described above are stored in special areas of the plant and are shaped specifically to be picked up and moved by suitable handling systems arranged in the paper converting plant.

SUMMARY

The main purpose of the present invention is to provide a system which allows to move the embossing rolls in a paper converting plant in a simple, effective and automatable way.

This result has been achieved, in accordance with the present invention, by means of a paper converting plant comprising means for producing logs of paper material starting from one or more paper webs fed by corresponding reels, with one or more unwinders on which the paper reels are arranged, an embossing unit that receives at least one of the webs coming from the paper reels and provides to its embossing, a bridge crane with arms provided with grippers, and a rewinder that produces logs using the webs coming from the embossing unit, wherein the embossing unit is arranged to be configured in a first use configuration in which one or more embossing rollers positioned inside it are stably locked to respective supports and a second removal configuration in which said one or more embossing rollers are disengaged from said supports such that the one or more embossing rollers can be extracted from the embossing unit when the plant also comprising a storing unit in which are stored one or more embossing rolls according to a predefined storage order such that each embossing roller occupies a known and predetermined position in the same storage unit, the bridge crane being provided above the one or more unwinders, the embossing unit, the rewinder and the storing unit. Each embossing roller has a respective longitudinal axis. The plant further comprises interface means reversibly associable to the grippers of the bridge crane and to each of the embossing rollers in a phase of movement of the embossing rollers, which interface means are interposed between the bridge crane and an embossing roller selected among those located in the embossing unit and in the storage unit and exhibits a first part shaped to be engaged by the grippers of the bridge crane and a second part shaped to engage the axial ends of the embossing roller providing an axial constraint that prevents the translation of the same embossing roller along the direction of its longitudinal axis.

Thanks to the present invention, it is possible to move the embossing rollers in a safe and reliable way. Furthermore, the process can be automated, with further benefits in terms of safety and costs.

BRIEF DESCRIPTION OF THE DRAWING

These and other advantages and characteristics of the invention will be best understood by anyone skilled in the art thanks to the following description and to the attached drawings, provided by way of example but not to be considered in a limitative sense, wherein.

DETAILED DESCRIPTION OF THE DRAWING

Figure 1A:
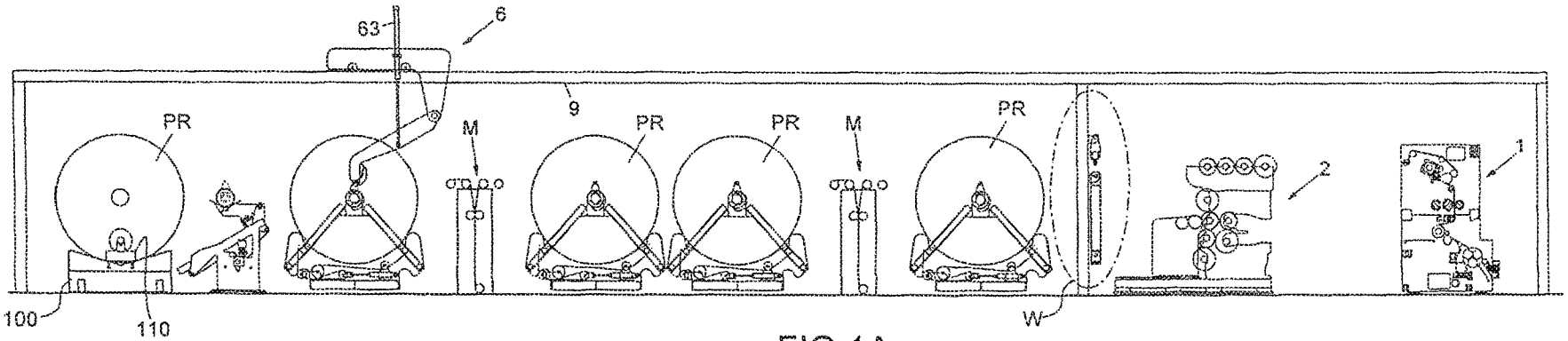
FIG. 1A is a schematic side view of a paper converting plant comprising a handling system according to the invention in a first operating configuration.
Figure 2A:
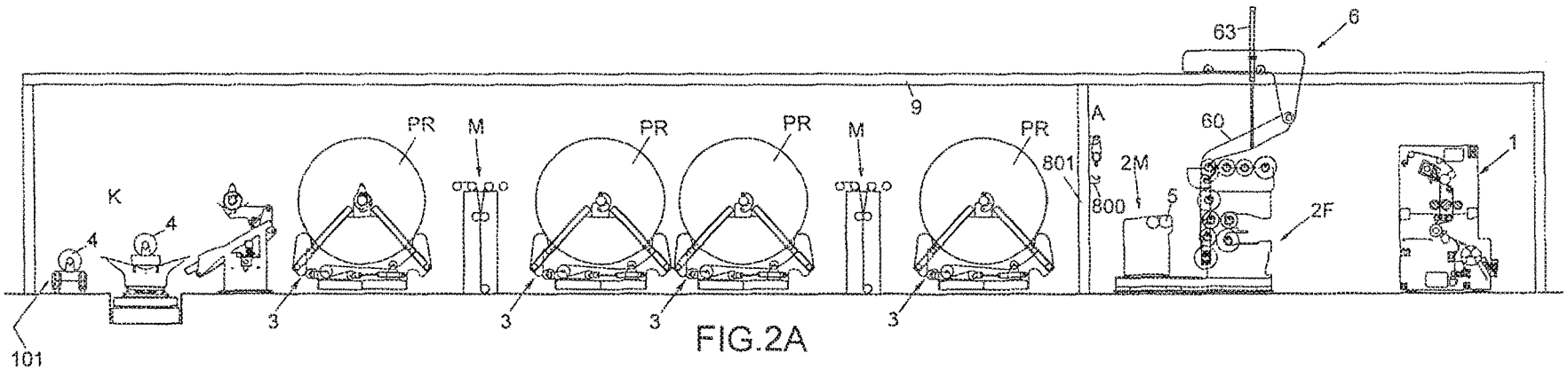
FIG. 2A is a schematic side view of the system shown FIG. 1 in a second operating configuration.
Figure 3:
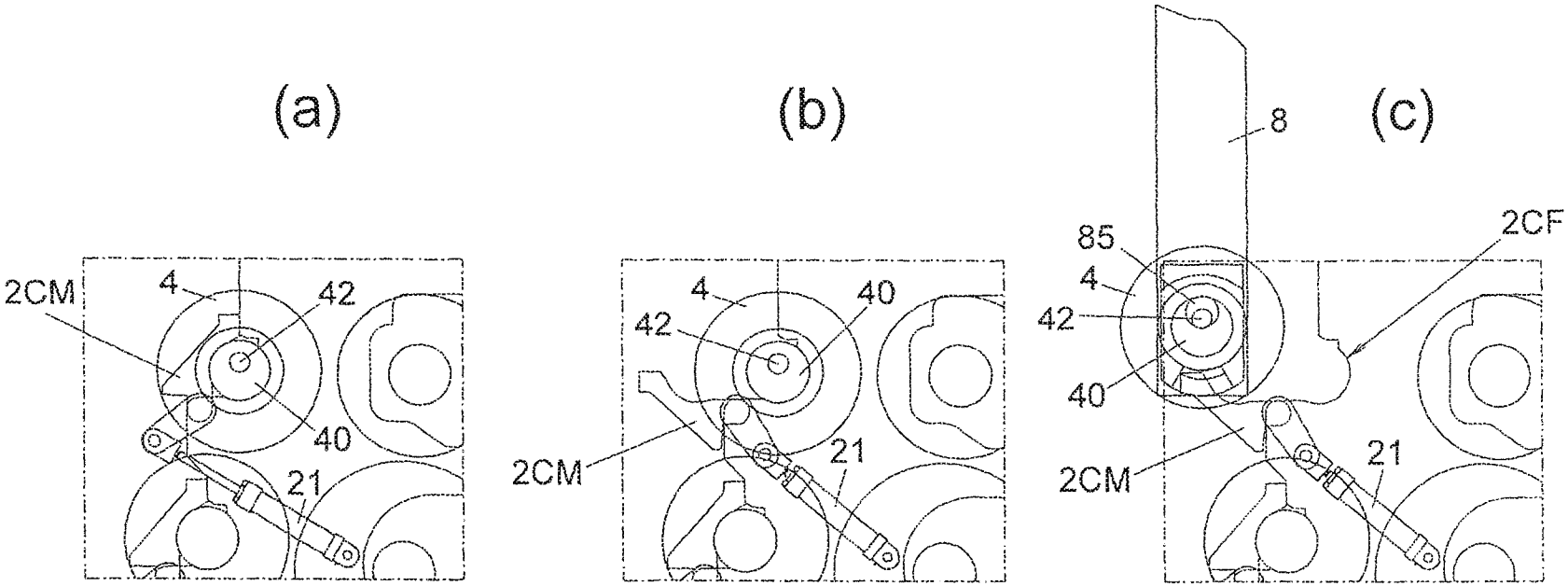
FIG. 3A represents a detail of FIG. 2A in different operating positions.
FIG. 3B represent a detail of FIG. 2A in different operating positions.
FIG. 3C represent a detail of FIG. 2A in different operating positions.

A handling system in accordance with the present invention can be used, for example, in a plant of the type illustrated in FIGS. 1A and 2A, i.e. in a plant of the type comprising a rewinding machine (1) destined to produce logs of paper material from a paper web composed of one or more plies subjected to embossing in an embossing unit (2) and supplied by corresponding parent reels (PR) placed on respective unwinders (3). In practice, in a plant of this type the plies supplied by the parent reels (PR), after having passed through a bonding unit (M) that is intended to join the tail of an almost exhausted parent reel (PR) with the paper of a new reel to ensure the continuity of production, reach the embossing (2) in which the plies are embossed and possibly glued to each other and, after the embossing phase, the plies reach the rewinder that produces the logs. The mechanical structure and operation of each of the above machines are known to those skilled in the art. Examples of rewinding machines are disclosed in U.S. Pat. Nos. 7,040,565 and 7,350,739. Examples of embossing units are disclosed in U.S. Pat. Nos. 7,481,643 and 3,556,907. Examples of unwinders are disclosed in U.S. Pat. Nos. 7,618,004 and 7,458,538. The embosser is of the type comprising a fixed part (2F) and a mobile part (2M), as shown by way of example in FIG. 2A forming a support structure for one or more embossing rollers (4). On the mobile part (2M) of said structure it is arranged a sizing unit (5) known per se. On the fixed part (2F) there are arranged of locking and respectively unlocking units for locking and unlocking the embossing rollers (4). In the example, these units are constituted, for each seat of an embossing roller (4), by a fixed semi-collar (2CF) formed on a side wall (20) of the support structure and a corresponding movable semi-collar (2CM) as shown by way of example in FIGS. 3A-3C. When the embossing roller (4) is locked to the structure of the embossing unit (2), each of the two axial ends (40) of the embossing roller is within the collar (2CF, 2CM) formed by the fixed semi-collar (2CF) and the mobile semi-collar (2CM), the latter being approached to said end (40) as shown in FIG. 3*a* by way of example; in order to release the roller (4) and allow its replacement, the mobile semi-collar (2CM) is rotated (counterclockwise in FIG. 3*b*) by means of an actuator (21) connected to it, such that the corresponding axial end (40) of the roller (4) is unlocked and the roller (4) can be removed as schematically shown in FIG. 3C and further described in the following. As previously mentioned, such a type of embossing unit is known per se to those skilled in the art. It is understood that, for the implementation of the present invention, a specific conformation of said locking units/unlocking of the embossing rollers (4) is not essential, being only provided that the embossing unit (2) is of the type comprising a mobile part (2M) and a fixed part (2F) which jointly form a support structure for the embossing roller (4) provided with locking and respectively unlocking means acting on the embossing rollers (4) to lock them to the support structure when the embossing unit is in operation and respectively to release them in a step of removal permitted.

In this example, it is also provided a bridge crane (6) equipped with operating arms (60) arranged to handle both the parent reels (PR) and the embossing rollers (4). The handling of the parent reels (PR) is provided when a parent reel is almost exhausted on one of the unwinders (3) and must be substituted with a new one that is ready to be picked up in a waiting point (P) of the plant.

Figure 2B:
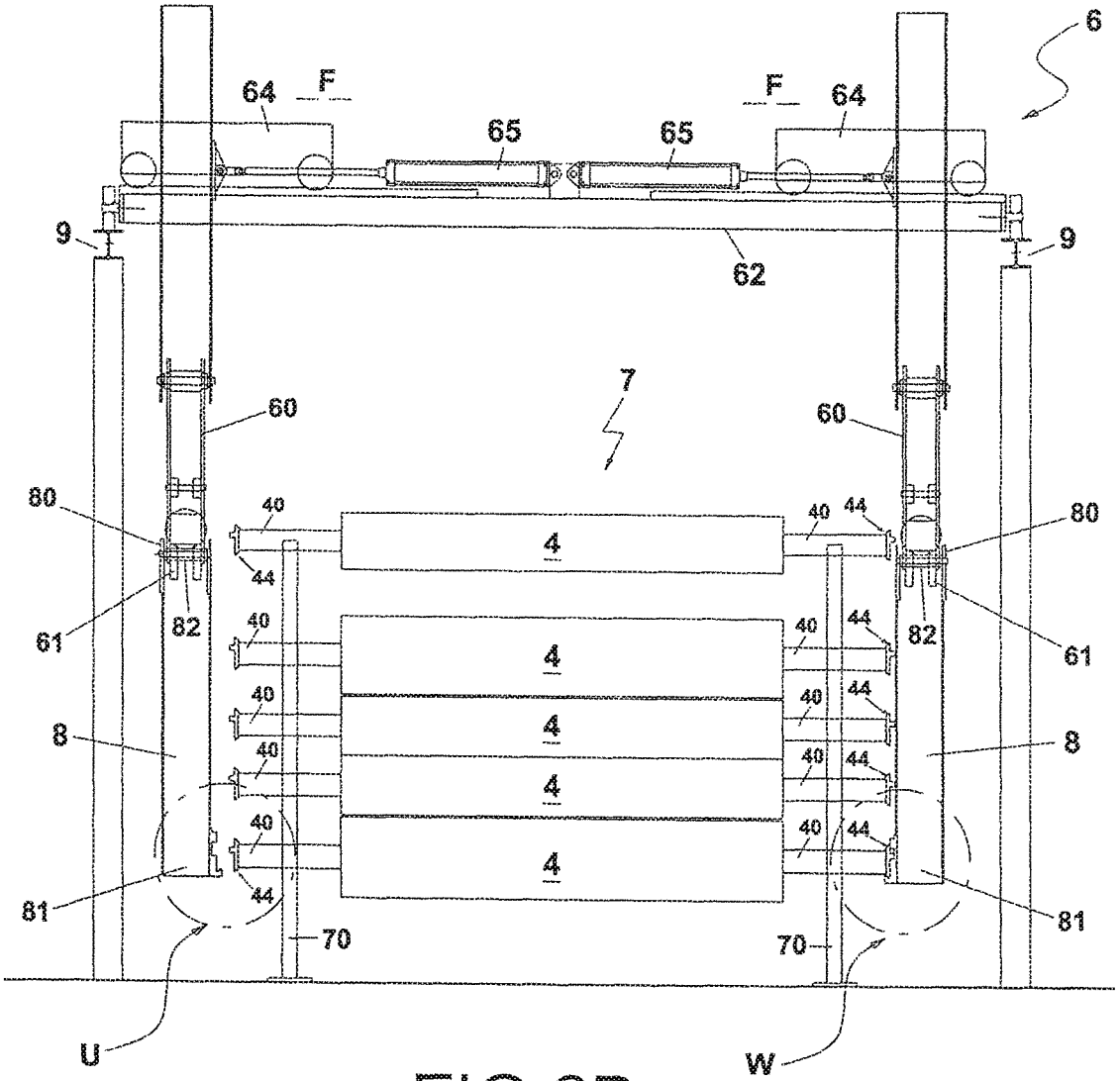
FIG. 2B is a schematic front view of the embossing rollers storing unit in a step of picking up of a roller by means of the bridge crane, wherein one end of the selected roller has been engaged while the opposite end of the same roller is not yet engaged.

The handling of the embossing rollers (4) is provided to replace an embossing roller as further described in the following. The arms (60) of the bridge crane (6) are provided with grippers (61) at their free ends (FIG. 2B). The plant also comprises a storing unit (7) in which are several embossing rollers (4) are stored in a predetermined order as schematically shown in FIG. 2B. Furthermore, in this example, the storing unit (7) is formed by a structure having two side walls (70) on each of which is formed a plurality of seats on which can be placed a corresponding end (40) of an embossing roller (4). The distance between said side walls (70) is such that the ends (40) of the embossing rollers (4) protrude by a predetermined value from each of them.

Advantageously, in accordance with the present invention, it is provided to arrange, in a predetermined point (A) of the plant, a pair of bars (8) each of which has an upper part (80) suitably shaped to be engaged by a corresponding arm (60) of the bridge crane (6) and a lower part (81) suitably shaped to engage an end (40) of an embossing roller (4). Bars (8) are shown in FIG. 2B, FIGS. 4-6, FIG. 8 and FIG. 9.

Figure 4:
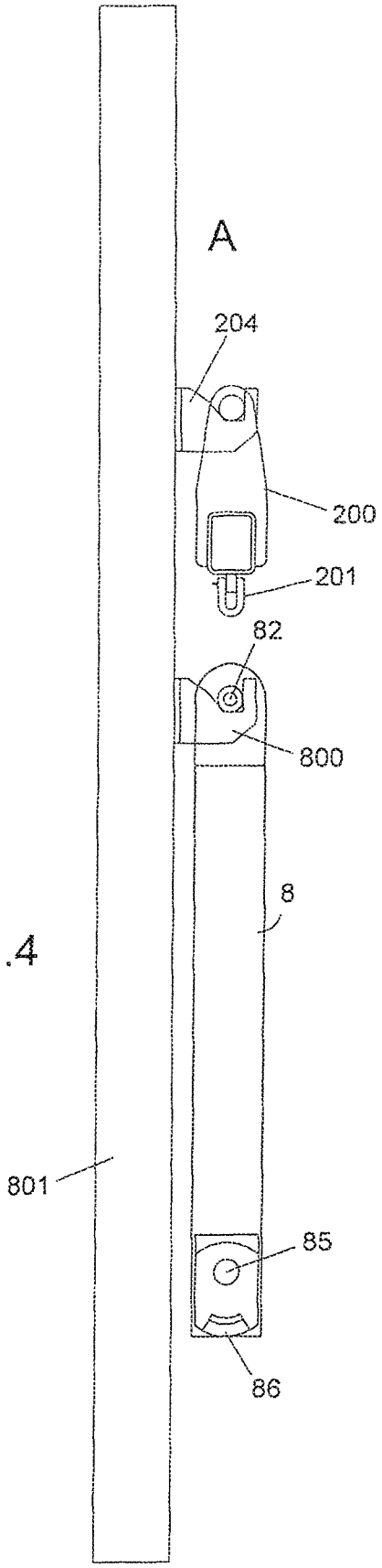
FIG. 4 is an enlarged view of the detail "U" of FIG. 2B.
Figure 5:
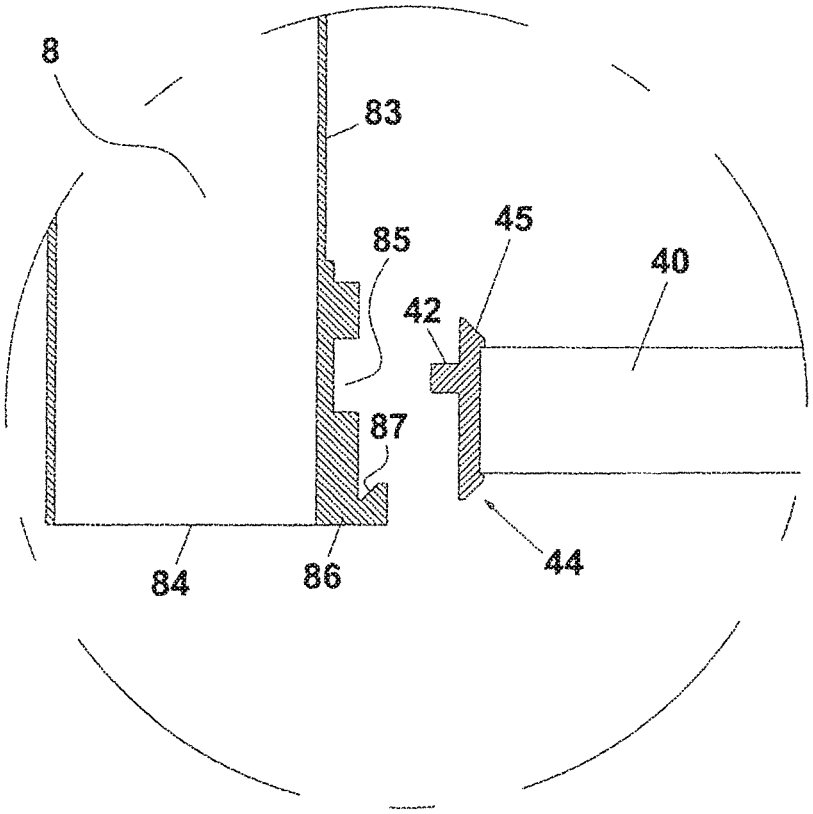
FIG. 5 is an enlarged view of the detail "V" of FIG. 2B.
Figure 8:
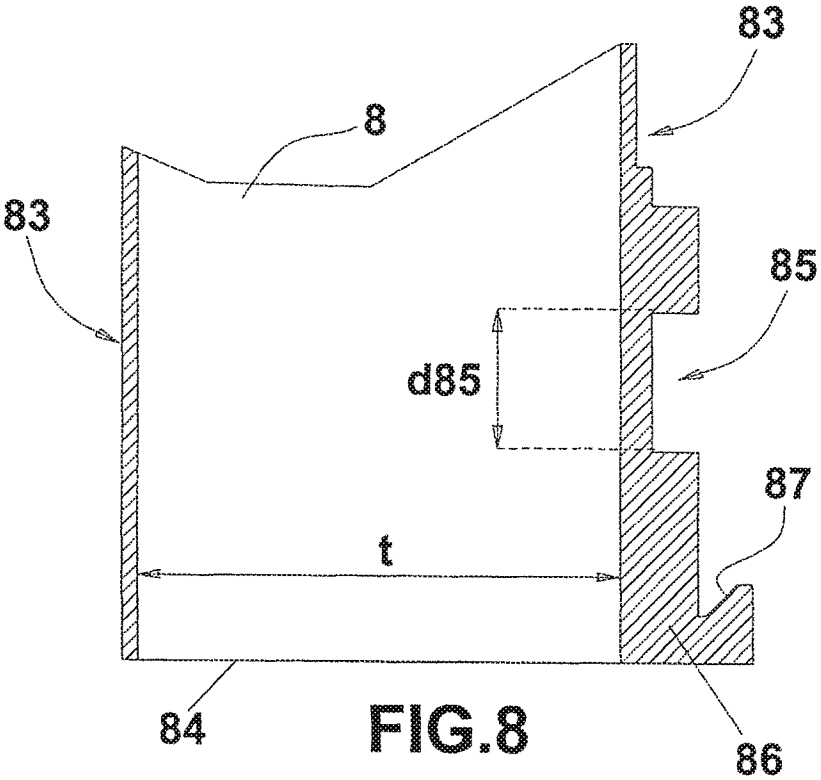
FIG. 8 shows the lower part of a bar.
Figure 9:
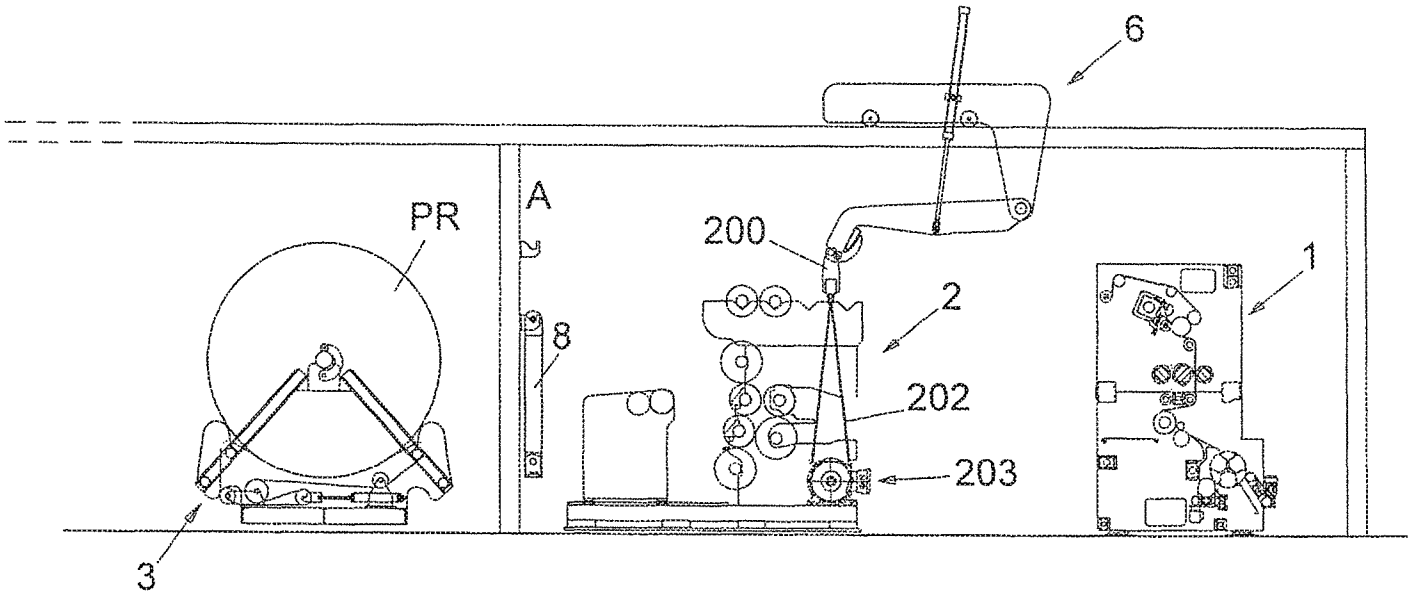
FIG. 9 shows a further mode of use of the bridge crane.

With reference to the example shown in the drawings, the upper part of each bar (8) has a pin (82) placed transversely between two side surfaces (83) of the same bar (8) that are spaced apart by a predetermined value (t). The pin (82) is shown in FIG. 2B and FIG. 4. The side surfaces (83) of the bar (8) and the distance (t) between the side surfaces (83) is shown in FIG. 8. Therefore, each bar (8) can be engaged by the gripper (61) of a corresponding arm of the bridge crane (6). In practice, the pin (82) constitutes a portion of the bar (8) suitably shaped to be engaged by an arm of the bridge crane. At the bottom, said surfaces (83) are joined by a plate (84). The plate (84) is shown in FIG. 5.

Figure 6:
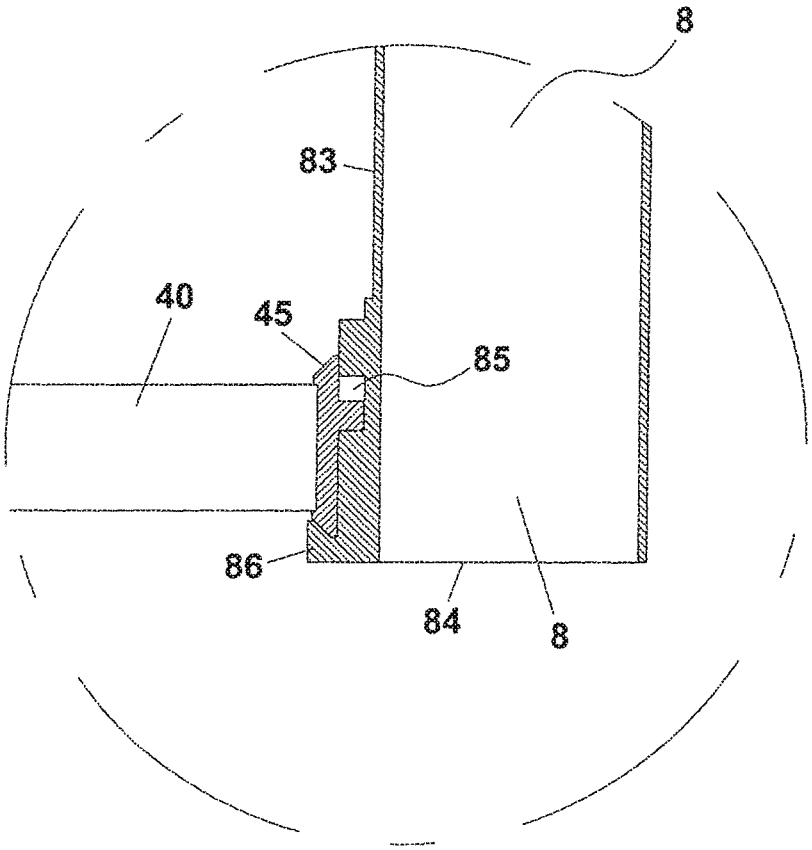
FIG. 6 is an enlarged view of the detail "W" of FIG. 1A.

The lower part of each bar (8) has, on the outer side of a respective surface (83), an engagement area with a blind hole (85) perpendicular to the same surface (83) and, below the hole (85), an appendix (86) defining a step (86) with a ramp (87) descending towards the same side surface (83) as shown by way of example in FIGS. 5-6. In use, such an engagement area faces the axial end (40) of an embossing roller (4) as further described in the following.

Figure 7:
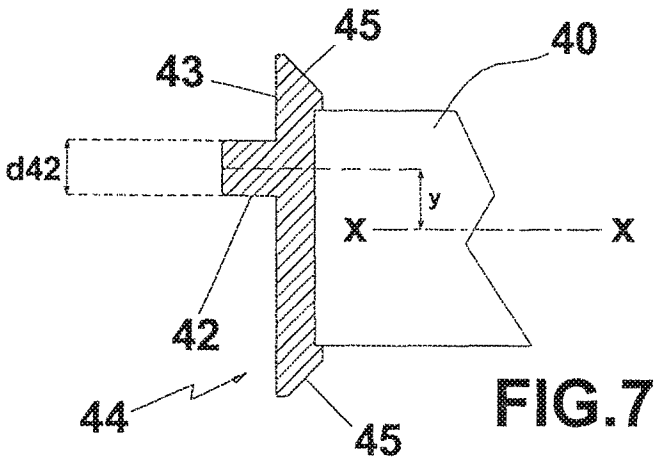
FIG. 7 shows a plate arranged on an axial end of an embossing roller.

As shown by of example in FIG. 2B and FIG. 7, the ends (40) of the embossing rollers (4) have, each, a plate (44) with an axial pin (42) projecting, along the rollers axial direction, from a respective outer surface (43) whose height (h) is greater than the diameter (d) of the end (40) of the roller (4). The diameter (d42) of said axial pin (42) is less than the diameter (d85) of the hole (85) arranged on the plate mounted on the lower part of the bar (8). The outer surface (43) of the plate (44) has an edge (45) converging towards the axis (x-x) of the embossing roller (4). Preferably, the axial pin (42) is spaced by a predetermined value (y) from the axis (x-x) of the embossing roller (4). In practice, as further described in the following, the plate (44) arranged on the end of the axial roller (40) is has a shape that is substantially complementary to the lower part of the bar (8).

In the step of removing a roller (4) from the embossing unit (2), the latter is disposed in the unlocking configuration to allow the removal of the chosen roller (FIG. 3*b*) while the grippers (61) arranged on the arms (60) of the bridge crane (6) engage, each, a bar (8) in its parking position (A). So engaged, the bars (8) are brought in correspondence of the embossing unit (2) and placed with the respective lower parts (81) in correspondence of the axial end (40) of the roller (4) to be removed. By approaching the arms (60) to each other, the pins (42) of the roller (4) are inserted in the holes (85) of the bars (8). Subsequently, the arms (60) are raised, such that the plates (44) are positioned each into a respective step (86), with the edges (45) laterally held by the ramps (87). Thus, the embossing roller (4) is stably associated to the bridge crane arms that transport it to the store unit (7) or at another point (K) of the plant where, for example, are placed the rollers to be maintained. The release of the roller (4) takes place by placing it in the desired place and opening the arms (60) with the bars (8) attached to them.

Subsequently, the bars (8) are moved towards the storing unit (7), i.e. towards another roller (4) chosen for replacement. The new roller (4) is collected as previously described with reference to the embossing unit. Thus collected, the new roller (4) is conveyed towards the embossing unit (2) where it is positioned in place of the roller previously removed. Once the arms (60) of the bridge crane and the bars (8) are spaced from the embossing unit (2), the half-collars (2CM) are re-arranged in the locking configuration for locking the new roller (4) and the embossing unit (2) can be started again.

Therefore, a system according to the present invention comprises:

- a bridge crane (6) with movable arms (60) provided with grippers (61) on the respective free ends;
- a storing unit (7) where several embossing rollers (4) are arranged according to a predetermined order such that each embossing roller (4) is in a known and preset position;
- an embossing unit (2) adapted to receive and use the embossing rollers (4) arranged in said storing unit (7);
- interface means reversibly associable to the grippers (61) of the bridge crane (6) and to each of the embossing rollers (4) in a phase of movement of the latter, which interface means are interposed between the bridge crane (6) and an embossing roller (4) selected among those located in the embossing unit (2) and in the storage unit (7) and exhibits a first part (80) shaped to be engaged by the grippers (61) of the bridge crane and a second part (81) shaped to engage the axial ends (40) of the embossing roller (4) providing an axial constraint that prevents the translation of the same embossing roller (4) along the direction of its longitudinal axis (x-x).

The interface means, that according to the example described above are constituted by bars (8), allow the use of the bridge crane (6) for handling both the embossing rollers (4) as previously said and for handling the reels (PR). The grippers (61) and the arms (60) of the bridge crane (6) do not need to be configured in a special way to fit the conformation of the reels (PR) or the conformation of the embossing rollers (4). Therefore, the bridge crane (6) normally provided in the plant in order to move the reels (PR) and other heavy loads can also be used for safely moving the embossing rollers (4) and handling them according to a predefined handling program that can be automatically controlled by programmable control systems of the plant itself. In particular, as mentioned above, the bridge crane (6) is capable of moving the embossing rollers (4) between the embossing unit (2) and the storing unit (7) or the waiting point (K) where the embossing rollers (4) subjected to maintenance or the rollers (4) intended to be brought to the storing unit (7) can be placed. For example, in said waiting point (K) can be used an automated cart of the AGV type (100) on which the embossing rollers are arranged (4). The waiting point (K) is shown by way of example in FIG. 2A.

Alternatively, or in addition, at the point (K) the embossing rollers (4) can be arranged on simple carriages (101). On the same AGV (100) can be positioned a support (110) on which can be placed, for example, the rollers (4) to be subjected to maintenance. The support (110) can have, for example, a box-like shape e adapted to hold a roll (4).

It is understood that the term "grippers" designates any gripping device mounted on the bridge crane arms.

Figure 1B:
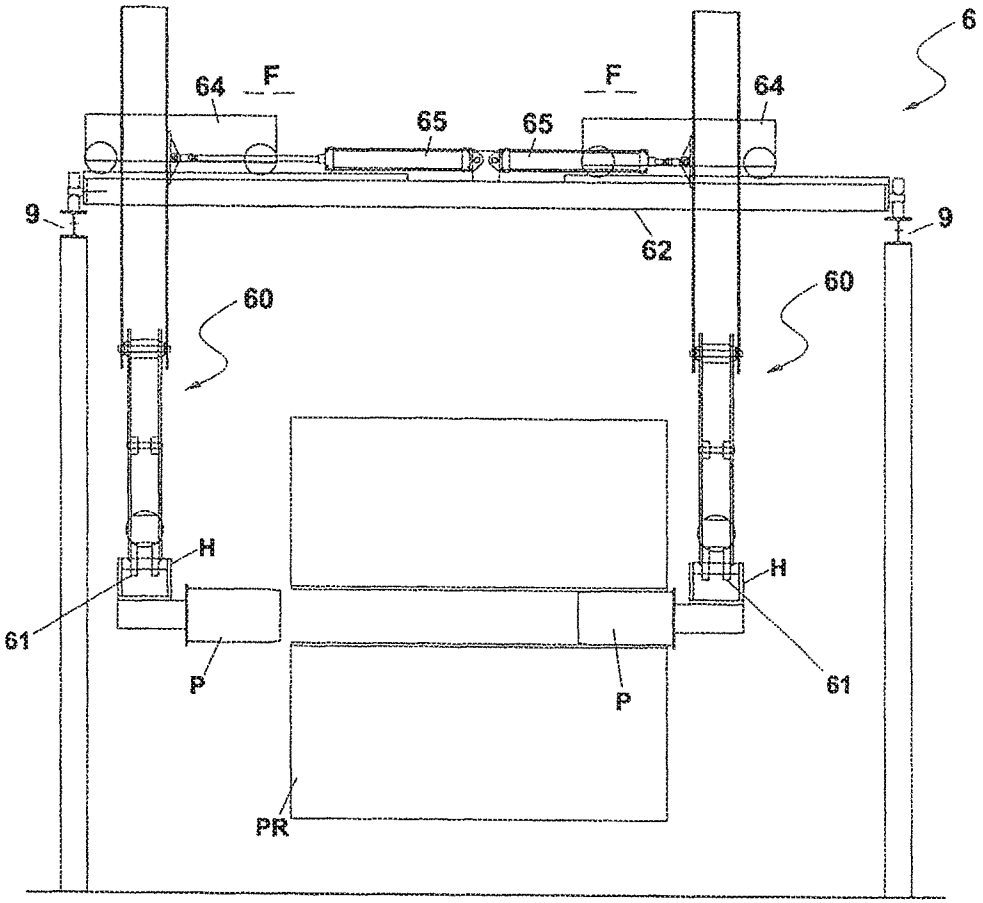
FIG. 1B is a schematic side view of a paper converting plant comprising a handling system according to the invention in a step of engagement of a reel of paper (PR) by the bridge crane.

FIG. 1A and FIG. 1B illustrate by way of example the bridge crane (6) when collecting a reel (PR): the same grippers (61) that engage the bars (8) for moving the rollers (4) are also used to hook the pins or "punches" (P) inserted centrally in the core (AR) of the reel (PR) and provided with handles (H) intended to be engaged by the grippers (61).

The bridge crane (6) shown in the accompanying drawings slides along a corresponding fixed guide (9) which develops above the machines constituting the plant. The bridge crane is of the type in which the arms (60) are each bound to a carriage (64) mounted on a superstructure (62) that slides along the fixed guide (9) and are operated by respective actuators (63). The carriages (64) are moved in a transverse direction relative to the guide (9) by corresponding horizontal actuators (65) for moving the arms (60) towards each other or away from each other by moving them parallel to themselves as indicated by arrows "F".

FIG. 4 shows a bar (8) placed in its parking position (A): the pin (82) also allows to suspend the bar (8) to a hook (800) fixed to a column (801) at a predetermined height. FIG. 4 also shows the concave shape of the step (86) in the lower part of the bar (8). The concavity of the step (86) is turned upwards, i.e. towards the overlying hole (85).

As schematically shown in FIGS. 1A, 2A and 4, for example in the same station (A) where the bars (8) are placed, it is possible to arrange, in a predetermined location, for example above (8) the suspension point of the bars, further equipments that can be handled by the bridge crane (6). For example, in such a position a beam (200) equipped with eyelets (201) on its underside can be removably positioned. One or more chains (202) usable for moving other components of the plant cans be connected to the eyelets (201) (in FIG. 9, the component is an electric motor 203 to be removed for maintenance operations). In FIG. 4 it can be noted that the aforesaid beam (200) is suspended to further hooks (204) fixed to the column (801) above the hooks (800). In this example, the taking and handling of the beam (200) by the bridge crane (6) are operations executable in automatic mode, that is, under control of a handling program, since the positions of the beam (200) and the component (203) to be moved are known. The application of the chains (202) to the eyelets (201) and to the component (203) to be moved is instead a manual operation. Therefore, in this example, the operation executed as a whole is a semi-automatic operation. It goes without saying that in the station (A) can be prepared various tools in addition to the bars (8) previously described. For example, in place of the beam (200), or in addition, it may also be arranged a winch.

The bridge crane is therefore freely usable also for other actions and not only for handling the embossing rollers. In practice the details of execution of the present invention may vary in any equivalent way for what concerns the individual elements described and illustrated without thereby departing from the scope of the adopted solution and thus remaining within the limits of the protection granted to the present patent.

The invention claimed is:

1. Paper converting plant, comprising:

means for producing logs of paper material starting from one or more paper webs fed by corresponding paper reels, with one or more unwinders on which said paper reels are arranged, an embossing unit that receives at least one of the webs coming from said paper reels and provides to its embossing, a bridge crane with arms provided with grippers, and a rewinder that produces logs using the webs coming from the embossing unit, wherein the embossing unit is arranged to be configured in a first use configuration in which one or more embossing rollers positioned inside it are stably locked to respective supports and a second removal configuration in which said one or more embossing rollers are disengaged from said supports such that the one or more embossing rollers can be extracted from the embossing unit when the embossing unit is in the second removal configuration, the plant also comprising a storing unit in which are stored one or more embossing rolls according to a predefined storage order such that each embossing roller occupies a known and predetermined position in the same storage unit, the bridge crane being provided above the one or more unwinders, the embossing unit, the rewinder and the storing unit, each embossing roller having a respective longitudinal axis, further comprising interface means reversibly associable to the grippers of the bridge crane and to each of the embossing rollers in a phase of movement of the one or more embossing rollers, which interface means are interposed between the bridge crane and an embossing roller selected among those located in the embossing unit and in the storage unit and exhibits a first part shaped to be engaged by the grippers of the bridge crane and a second part shaped to engage the axial ends of the embossing roller providing an axial constraint that prevents the translation of the same embossing roller along the direction of its longitudinal axis.

2. Plant according to claim 1, further comprising a station where said interface means are parked, said station being provided between the one or more unwinders and the embossing unit.

3. Plant according to claim 1, wherein said interface means comprise two identical bars, each of which has a first upper part having a body adapted to be hooked by said grippers and a second lower part defining a seat in which a surface of a corresponding axial end of the selected embossing roll is insertable.

4. Plant according to claim 3, wherein the seat comprises a hole oriented transversely to the bar and, below the hole, an appendix which forms a step with a ramp descending towards a side surface of the bar where the same seat is arranged and in that said surface has a pin projecting in the axial direction and an edge converging towards the axis of the selected embossing roll.

5. Plant according to claim 4, wherein the diameter of said hole is greater than the diameter of said axial pin.

6. Plant according to claim 1, further comprising further equipment that are handled by the bridge crane, the further equipment including a beam that is provided with eyelets on its underside, wherein the beam is removably connected to the bridge crane.

7. Plant according to claim 1, further comprising a station where the embossing rolls removed from the embossing and not intended for the store are parked, said station being provided at a first side of the one or more unwinders, the first side opposite to a second side of the one or more unwinders where the embossing unit is located.

8. Plant according to claim 7, wherein in said station is arranged a support adapted to contain an embossing roll.

* * * * *